US008095050B2

(12) United States Patent
Iwata et al.

(10) Patent No.: US 8,095,050 B2
(45) Date of Patent: Jan. 10, 2012

(54) DEVELOPER LEVEL CONTROL BLADE AND PROCESS FOR MANUFACTURING DEVELOPER LEVEL CONTROL BLADE

(75) Inventors: Kazuaki Iwata, Toride (JP); Naohiko Nakano, Ryugasaki (JP); Toru Ishigaki, Matsudo (JP)

(73) Assignee: Canon Kasei Kabushiki Kaisha, Tsukuba-shi (JP)

( * ) Notice: Subject to any disclaimer, the term of this patent is extended or adjusted under 35 U.S.C. 154(b) by 731 days.

(21) Appl. No.: 12/051,526

(22) Filed: Mar. 19, 2008

(65) Prior Publication Data

US 2008/0247791 A1 Oct. 9, 2008

(30) Foreign Application Priority Data

Apr. 4, 2007 (JP) ..... 2007-098359

(51) Int. Cl.
*G03G 15/09* (2006.01)

(52) U.S. Cl. ..... 399/274; 399/350; 399/284

(58) Field of Classification Search ..... None
See application file for complete search history.

(56) References Cited

U.S. PATENT DOCUMENTS

| | | | |
|---|---|---|---|
| 5,689,783 | A | 11/1997 | Sasame et al. |
| 7,016,633 | B2 | 3/2006 | Ishigaki |
| 7,074,292 | B2 | 7/2006 | Ishigaki et al. |
| 2003/0070748 | A1 | 4/2003 | Ishigaki et al. |
| 2003/0194250 | A1 | 10/2003 | Ishigaki |
| 2005/0260014 | A1 | 11/2005 | Nakano et al. |
| 2006/0202376 | A1 | 9/2006 | Ishigaki et al. |
| 2007/0147905 | A1 | 6/2007 | Nakano et al. |

FOREIGN PATENT DOCUMENTS

| | | | |
|---|---|---|---|
| CN | 1452028 | A | 10/2003 |
| JP | 2002-116622 | A | 4/2002 |
| JP | 2002-372854 | A | 12/2002 |
| JP | 2002-372855 | A | 12/2002 |
| JP | 2002-372858 | * | 12/2002 |
| JP | 2002-372858 | A | 12/2002 |
| JP | 2006-30864 | A | 2/2006 |

OTHER PUBLICATIONS

Chinese Office Action dated Nov. 27, 2009, in Chinese Application No. 2008-100906260.

* cited by examiner

*Primary Examiner* — David Gray
*Assistant Examiner* — Roy Y Yi
(74) *Attorney, Agent, or Firm* — Fitzpatrick, Cella, Harper & Scinto

(57) ABSTRACT

A developer level control blade is provided which can form a developer layer on a developer carrying member in a proper thickness and in a uniform state and can keep the developer, in particular, color toner particles from melt-adhering to the charge control face so that faulty images such as lines and non-uniformity can be kept from occurring. Also provided is a process for manufacturing this developer level control blade. The process for manufacturing the developer level control blade is characterized by having the steps of extruding a blade member material melted to liquefy, covering therewith a support member thin-plate metal member at an edge portion thereof to join the both together, and cooling the blade member material to solidify, followed by cutting in a preset length.

13 Claims, 3 Drawing Sheets

DEVELOPER LEVEL CONTROL BLADE AND PROCESS FOR MANUFACTURING DEVELOPER LEVEL CONTROL BLADE

BACKGROUND OF THE INVENTION

1. Field of the Invention

This invention relates to a developer level control blade which controls the level (extent of quantity) of a developer used to develop electrostatic latent images formed on an image bearing member of an electrophotographic apparatus or the like, to render the latent images visible, and relates to a process for manufacturing the developer level control blade.

2. Description of the Related Art

An electrophotographic apparatus such as an electrophotographic copying machine, a laser beam printer or a facsimile machine is conventionally provided with a developing assembly. The developing assembly is chiefly provided with a roller-shaped developer carrying member which is so disposed as to close an opening, and stand partly bare to the outside, of a developer container holding therein a developer (also called a toner), and a developer level control blade which is disposed in touch with the surface of this developer carrying member and which keeps at a constant level the developer the developer carrying member carries.

As the developer carrying member is rotated, the developer having adhered to the surface of the developer carrying member passes through between the developer carrying member and the developer level control blade, where its excess portion is removed from the surface of the developer carrying member and returned to the interior of the developer container. Thus, the developer is formed in a thin layer on the developer carrying member. At the same time, the developer on the developer carrying member surface is provided with triboelectric charges (also called triboelectricity) upon its friction with the developer level control blade and, at the part where the developer carrying member stands bare from the developer container, moves from the developer carrying member surface to electrostatic latent images formed on the surface of an electrophotographic photosensitive member which rotates facing the developer carrying member.

As such a developer level control blade, a blade having a blade member which is to be brought into pressure contact with the developer carrying member and a support member which supports this blade member at a preset position is used. As the developer level control blade of such a type, a blade in which a platelike blade member made of a rubbery elastic material has been bonded to a preset position of a support member made of a metal, is in wide use because it can be brought into pressure contact with the developer carrying member at a uniform force over its whole length and has a durability. The face of the blade member that is brought into contact, i.e., pressure contact, with the developer carrying member has the function to control triboelectric charges of the developer. Accordingly, this face is also called a charge control face. In such a blade member, as materials for the charge control face, for example, urethane rubbers, urethane resins or polyamide elastomers are used with respect to negative-type toners, and silicone rubbers are used with respect to positive-type toners.

Further, with respect to non-magnetic toners used in forming color images, the charge control face is required to provide the toner with high triboelectric charges because the toner itself does not have any magnetic properties, to enable formation of a thin layer on the developer carrying member. As materials for such a charge control face, urethane rubbers, polyamide resins, polyamide elastomers, silicone rubbers, silicone resins and the like are used, and the charge control face is finished in a good face precision.

In recent years, fine-particle toners are used in developing assemblies, having been made high in image quality and made full-color, which are applied to electrophotographic processes, and hence a developer level control blade is required which can enjoy more uniform pressure contact with the developer carrying member. Accordingly, a developer level control blade is reported which is made up of a blade member, an adhesive and a support member which have been so laminated as to form layers standing just laid over each other in their whole area, having substantially the same shape with each other (Japanese Patent Application Laid-open No. 2002-372858). A blade is also reported which has a blade member and a support member and which has a blade edge shape such that the blade member is provided with i) a first slope at an edge portion formed by a sliding face and an edge face, of the blade member, and ii) a second slope at another edge portion formed by the edge face and a bonded face at which the blade member is bonded to the support member (Japanese Patent Applications Laid open No. 2002-372854 and No. 2002-372855). The use of such a blade enables any color toner particles to be effectively kept from melt-adhering to the charge control face (charge-providing face) of the developer level control blade, even in color copying machines and color laser printers which are made high-speed and highly durable.

However, in developing assemblies having been made higher in image quality, made more high-speed and made more highly durable in electrophotographic processes in recent years, it is required that a toner controlled to a proper level is more uniformly pressed against, and made to adhere to, the developer carrying member. Even when the developer level control blade disclosed in the above Japanese Patent Applications Laid-open No. 2002-372854 and No. 2002-372855 is employed, in the color toner purpose developing assemblies having been made high in image quality and high-speed, it is required that the toner is uniformly pressed against, and made to adhere to, the developer carrying member while being controlled thereon to a proper level. Besides, where further fine-particle toners are used, too, it is sought to provide a developer level control blade which can keep the color toner particles from melt-adhering to the charge control face. It is also sought to provide a process for manufacturing such a developer level control blade.

SUMMARY OF THE INVENTION

A subject of the present invention is to secure a certain toner intake between the developer level control blade and the developer carrying member to make uniform the pressure of contact of the blade with the developer carrying member so that a developer layer can be formed on the developer carrying member in a proper thickness and in a uniform state. A further subject of the present invention is to keep the developer, in particular, color toner particles from melt-adhering to the charge control face so that faulty images such as lines and non-uniformity can be kept from occurring.

Accordingly, an object of the present invention is to provide a developer level control blade which resolves the above subjects, and a manufacturing process by which such a developer level control blade can continuously be formed so as to be worked at a low cost.

The present invention provides a process for manufacturing a developer level control blade having at least a support member and a blade member, which controls the level of a developer carried by a developer carrying member out of a developer container; the process being characterized by having the steps of: placing in an extruder die for giving a blade edge shape a continuous thin-sheet metal member for forming the support member, at a position where the metal member is to be provided with a liquid blade member material for forming the blade member (a metal member placing step); extruding the blade member material, having been melted to liquefy, into the extruder die (a blade member material extruding step); covering the continuous thin-plate metal member at an edge portion thereof with the liquid blade member material to join the both together (a material covering step); cooling the blade member material on the continuous thin-plate metal member to solidify to form a continuous blade (a cooling-to-solidify step); and cutting the continuous blade in a preset length (a cutting step).

In the above material covering step, the shape of the blade may be adjusted by adjusting an extrusion orifice of the extruder die, from which the liquid blade member material is ejected together with the continuous thin-plate metal member in an integral form.

The present invention further provides a developer level control blade characterized by being formed by the above process for manufacturing a developer level control blade.

Further features of the present invention will become apparent from the following description of exemplary embodiments with reference to the accompanying drawings.

DESCRIPTION OF THE EMBODIMENTS

The developer level control blade formed by the present manufacturing process can secure a certain toner intake between the developer level control blade and the developer carrying member to make uniform the pressure of contact between them, whereby a developer layer can be formed on the developer carrying member in a proper thickness and in a uniform state. Further, the developer, in particular, color toner particles can be kept from melt-adhering to the charge control face, so that faulty images such as lines and non-uniformity can be kept from occurring.

Figure 1:
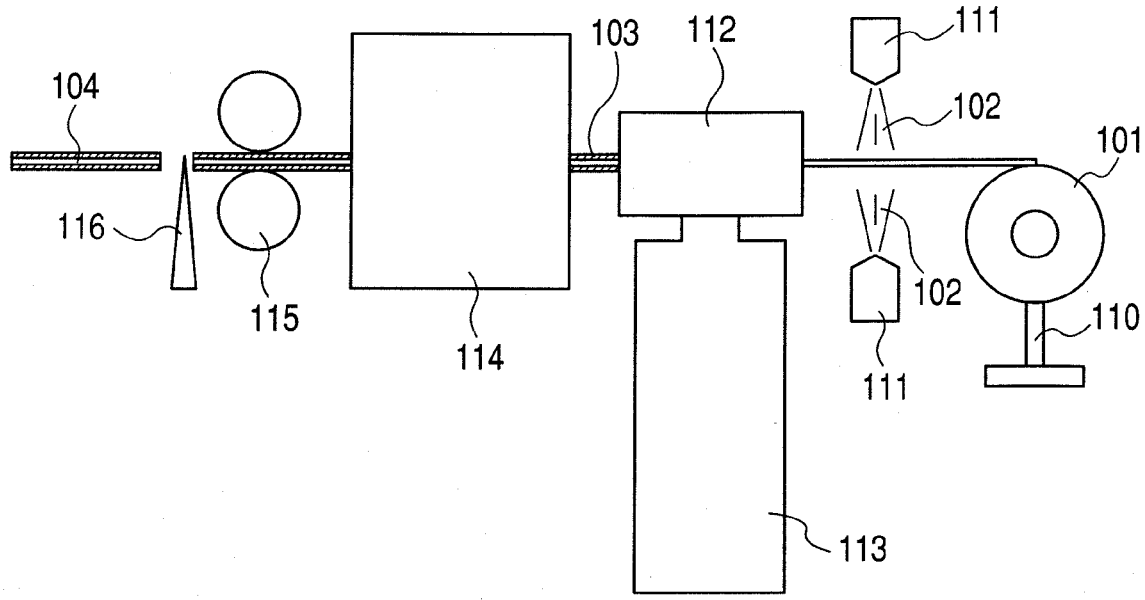
FIG. 1 is a schematic view showing the construction of an apparatus for manufacturing the developer level control blade of the present invention.

An apparatus which practices the developer level control blade manufacturing process of the present invention may specifically include what is shown in FIG. 1 as an example. The apparatus shown in FIG. 1 is made up of a coil stand 110 for feeding to the apparatus main body a continuous thin-sheet metal member 101 which is to form the support member, an extruder 113 for melting a blade member material 103 to liquefy and extrude therefrom the blade member material 103 having been liquefied, an extruder die 112 for covering the support member continuous thin-sheet metal member 101 with the liquid blade member material 103 to join the both together, a cooling unit 114 for solidifying the liquid blade member material 103 on the continuous thin-sheet metal member 101 as the support member, a roll unit 115 for transporting the support member to which the blade member stands joined, as a continuous blade formed as a result of cooling, and a cutter 116 with which the continuous blade thus formed is cut into the shape of a developer level control blade 104.

In order to improve adhesion between the support member and the blade member, coating units 111 for applying an adhesive 102 may optionally be provided at a stage prior to the extruder die 112 as occasion calls.

The continuous thin-sheet metal member 101 which is to form the support member, kept set on the coil stand, is forwarded at a constant speed to the extruder die 112 in the state a tension is applied, and is positionally fitted in the extruder die 112 as a metal member for the support member (a metal member placing step).

At the same time, the liquid blade member material 103, having been melted in the extruder 113, is extruded into the extruder die 112 at a constant extrusion rate (a blade member material extruding step). Here, in the extruder die 112, the blade member material 103 is so disposed that the metal member for the support member is partly covered therewith (a material covering step).

More specifically, the blade member material 103 having been liquefied, and the continuous thin-sheet metal member 101 which is to form the support member, are held in the extruder die 112 while being heated therein, where the latter is partly covered at its edge portion with the former to join the both together. In order to improve the force of joining between the blade member material 103 and the metal member 101 for support member, it is preferable for the latter to be heated before it is inserted into the extruder die 112. It is more preferable to use an adhesive between the blade member material 103 and the metal member 101 for the support member. That is, it is more preferable that the blade member is formed on the support member via an adhesive layer.

The blade member material 103 thus joined with the continuous thin-sheet metal member 101 for the support member in the extruder die 112 is extruded therefrom after the shape of its extrusion orifice (see 32 in FIG. 3); thus the shape (sectional shape) of the developer level control blade 104 at its part extending from the contact support face to the edge face of its support member is given as, e.g., shown later with reference to FIG. 2. Here, in the extruder die 112 from which the blade member material 103 is forced out together with the continuous thin-sheet metal member 101 for the support member, its extrusion orifice 32 may be changed in shape, whereby the shape (sectional shape) of the developer level control blade 104 at its part extending from the contact support face to the edge face of its support member can be adjusted.

Next, the blade member material 103 joined with the continuous thin-sheet metal member 101 for support member is cooled to solidify in the cooling unit 114 to form a continuous blade made up of the support member and blade member joined together (a cooling-to-solidify step).

The continuous blade made up of the support member and blade member thus joined together is then cut in a preset length by means of the cutter 116 into the shape of the developer level control blade 104 (a cutting step).

In the present invention, what is intended is stable formation of the edge shape of the blade member. If the edge shape of the blade member is desired to be more complex, a method is also available in which liquid droplets of the blade member material are applied and made into an intended shape by being pressed against a desirable mold before being solidified.

The developer level control blade of the present invention has at least the support member and the blade member which co-operatively control the level of the developer carried by the developer carrying member out of the developer container.

As the support member used in the developer level control blade, there are no particular limitations thereon as long as it has a contact support face which supports a blade face coming into touch with the developer carrying member and which can support a cover layer serving as the blade member.

As the shape of the support member, it may preferably have the shape of a flat sheet having the contact support face for supporting the blade member coming into contact with the developer carrying member, or the shape of a curved-surface sheet formed by bending the flat sheet.

The support member may preferably have a thickness of from 0.05 mm or more to 0.15 mm or less. As long as the support member has a thickness of 0.05 mm or more, the blade member can be brought into contact with the developer carrying member under a proper contact pressure, so that toner particles can be pressed against, and made to adhere to, the developer carrying member by means of necessary pressure. On the other hand, as long as the support member has a thickness of 0.15 mm or less, it can make the blade member follow up the developer carrying member surface with ease, and can have a spring action proper enough to provide developer particles with the necessary pressure to the developer carrying member.

The blade member used in the developer level control blade is made of a cover layer formed of a material containing a resin or an elastomer, formed on the support member having the contact support face which supports the blade face coming into contact with the developer carrying member. Further, it is a member with which the support member is covered at least at its part extending from the contact support face to the edge face. Inasmuch as the cover layer is formed in the state the support member is covered therewith not only at the contact support face but also at the part extending from the contact support face to the edge face, a certain toner intake can be secured between the developer level control blade and the developer carrying member to make proper and uniform the toner level (developer level) on the developer carrying member. Further, the blade member may cover the support member at its edge where the contact support face crosses the edge face, thus having a shape free of any corner (edge). This is preferable because the toner can be taken in with ease at the toner intake and a toner layer (developer layer) having a uniform layer thickness can be formed on the developer carrying member.

It is preferable for the cover layer to be formed also on the back surface of the support member, the back surface being opposed to its contact support face. Inasmuch as the cover layer is formed also on the back surface of the support member, the support member is kept from deforming, e.g., warping, so that the developer level control blade can be made to come into pressure contact with the developer carrying member over the former's whole length and at a uniform pressure contact force.

The blade member may preferably have a thickness of from 10 μm or more to 500 μm or less at its part on the contact support face of the support member. As long as the blade member covering the support member has a thickness of 10 μm or more at its part on the contact support face of the support member, it can be kept from wearing as a result of its friction with the developer carrying member which results in low durability. As long as it has a thickness of 500 μm or less at that part, it can provide itself with a stable pressure of contact with the developer carrying member. At its part on the edge face of the support member, the blade member may preferably have a thickness of from 5 μm or more to 600 μm or less. As long as the blade member covering the support member has a thickness of 5 μm or more at its part on the edge face of the support member, it can be kept from becoming low durable. As long as it has a thickness of 600 μm or less at that part, it can form on the developer carrying member a toner layer having a stable layer thickness.

As materials for the blade member, they may be selected according to types of toners and particle diameters thereof, and may preferably be materials having good charge-providing properties to toners. Stated specifically, polyamides, polyamide elastomers, polyesters, polyester elastomers, polyester terephthalate, polyurethanes, silicone rubbers, silicone resins, melamine resins and so forth may be selected, which are those having good charge-providing properties to toners. Any of these may be used alone or in combination of two or more types. To these elastomers and resins, additives such as conducting materials may also be added in order to provide the toners with a stated chargeability. The conducting materials may include carbon black and metallic materials.

Additives such as a charge-providing agent and roughening particles may optionally further be added to the cover layer of the blade member covering the support member.

The cover layer may preferably have a surface roughness of from 0.1 μm or more to 3.0 μm or less as ten-point average roughness (Rz) at least at its face of touch with the developer carrying member. As long as the cover layer has a surface roughness of 0.1 μm or more, the cover layer can keep any fine scratches or non-uniformity on its surface from affecting images to be formed. As long as it has a surface roughness of 3.0 μm or less, a uniform developer layer kept from lines or non-uniformity can be formed on the developer carrying member.

Herein, as the ten-point average roughness (Rz) of surface roughness, measured values may be employed which are measured with a contact type surface roughness meter as prescribed in JIS B 0601.

Figure 2:
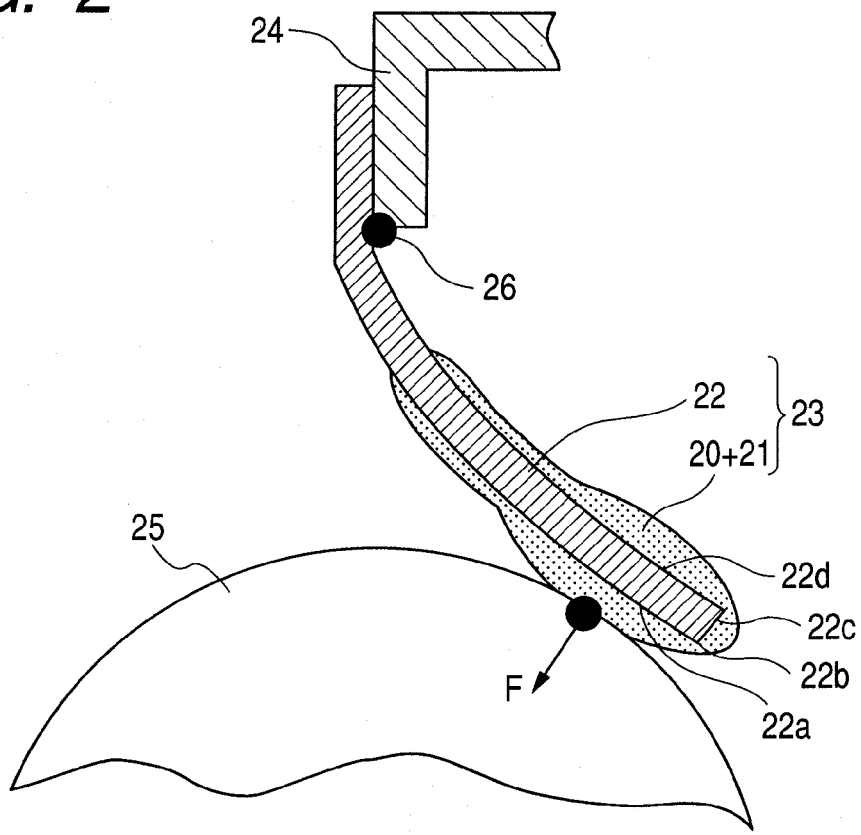
FIG. 2 is a schematic view showing the construction of an example of the developer level control blade of the present invention.

The developer level control blade produced using the above support member and blade member may specifically include what is shown in FIG. 2.

The developer level control blade, 23, shown in FIG. 2 is made up of a support member 22 and a blade member consisting of a blade member 20 and an adhesive material 21. The blade member 20+21 is integrally formed on the support member 22, covering the latter's corner (edge) 22*b* formed between a tem contact support face 22*a* and an edge face 22*c* and extending from the contact support face 22*a* to its back surface 22*d*. This developer level control blade 23 is fastened to a developing assembly 24 in such a way that the former's contact face comes into pressure contact with the surface of a developer carrying member 25 at a pressure contact force F, setting as a fulcrum a fastening point 26 which comes into contact with an opening end of the developer container 24. As being made up in this way, the developer level control blade 23 can form an intake from which toner particles in a proper quantity are introduced to the part between the developer level control blade 23 and the developer carrying member 25, and can form on the developer carrying member 25 a developer layer having a uniform and sufficient charge quantity. Further, it can keep its support member from warping.

Figure 4:
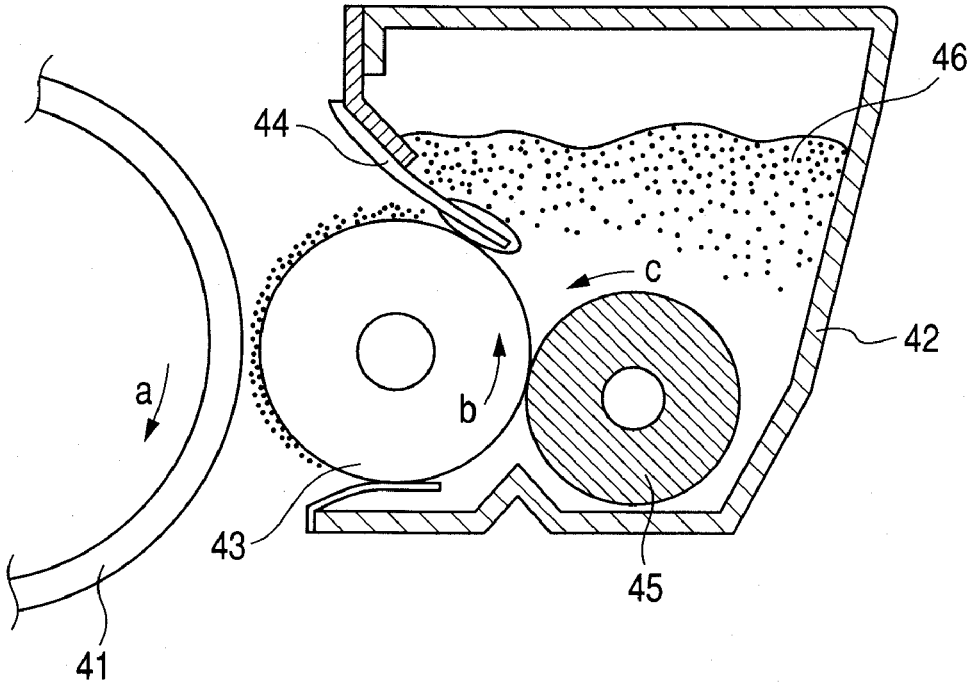
FIG. 4 is a schematic view showing the construction of an example of a developing assembly in the present invention.

The developing assembly in the present invention is one making use of the developer level control blade described above. As an example thereof, it may include what is shown in FIG. 4. The developing assembly shown in FIG. 4 is provided with a developer container 42 holding therein a one-component developer 46, and an elastic roller 45 and a developer carrying member 43 which are rotatably provided inside and half inside, respectively, the container. The elastic roller 45 is so disposed as to have a nip width on the developer carrying member 43. The developer carrying member 43 is so provided as to close the opened side of the developer container 42 in the state substantially the half periphery of the developer carrying member 43 is held inside the developer container 42 and the remaining half periphery of the developer carrying member 43 comes out of the developer container 42, and is set opposite to an image baring member photosensitive member 41, leaving a minute gap between them. The developer carrying member 43 is kept movable by means of a moving means which makes micro-adjustment of the gap between it and the photosensitive member 41, thus the developer on the developer carrying member 43 can be made to well move to the photosensitive member 41. Further, a developer level control blade 44 according to the present invention is so provided as to come into contact with the developer carrying member 43 in the state where it is fastened to the developer container 42 at its opening end portion.

In such a developing assembly, the elastic roller 45 is rotated in the direction of an arrow c, and is brought into pressure contact with the surface of the developer carrying member 43 kept rotated in the direction of an arrow b, so that the developer is pressed against, and made to adhere to, the surface of the developer carrying member 43. The developer thus pressed against, and made to adhere to, the surface of the developer carrying member 43 comes into the part between the developer level control blade 44 and the developer carrying member 43 as the developer carrying member 43 is rotated in the direction of the arrow b. Then, when it passes through this part, it is rubbed with the surface of the developer carrying member 43 and with the blade member of the developer level control blade 44 to come triboelectrically charged. The developer thus charged is made into a thin layer on the developer carrying member 43 by means of the developer level control blade 44, and is carried out of the developer container as the developer carrying member 43 is rotated. Then, the developer on the developer carrying member 43 moves onto and adheres to electrostatic latent images having been formed on the electrophotographic photosensitive member 41 rotated in the direction of an arrow a, to develop and render visible the electrostatic latent images as toner images.

The developer not consumed in the development of the electrostatic latent images and remaining on the developer carrying member 43 is collected into the developer container 42 at the lower part of the developer carrying member 43 as the developer carrying member 43 is rotated. The developer thus collected is taken off from the surface of the developer carrying member 43 at the nip zone between it and the elastic roller 45. At the same time, as the elastic roller 45 is rotated, the developer in the developer container 42 is anew fed onto the developer carrying member 43. The developer fed anew passes through the part between the developer level control blade 44 and the developer carrying member 43, and is transported onto the photosensitive member 41. Meanwhile, the greater part of the developer taken off from the developer carrying member 43 is, as the elastic roller 45 is rotated, transported into the developer container 42 and mutually mixed with the developer held therein, where the triboelectric charges of the developer taken off are dispersed.

The electrophotographic apparatus in which such a developing assembly having the developer level control blade according to the present invention is usable may include copying machines, laser beam printers, LED printers, and apparatus where electrophotography is applied, such as electrophotographic platemaking systems.

EXAMPLES

The developer level control blade manufacturing process of the present invention is described below in greater detail by giving Examples. The technical scope of the present invention is by no means limited to these.

Example 1

In manufacturing the developer level control blade, the apparatus as shown in FIG. 1 was used.

A phosphor bronze sheet of 200 mm in length, 23 mm in width and 0.1 mm in thickness (available from Harada Metal Industry Co., Ltd.) was used as the continuous thin-sheet metal member 101 for the support member. A polyamide elastomer (DAIAMID E40, available from Daicel-Degussa Ltd.) having a Shore D hardness of 40 degrees was used as a material for the blade member.

Figure 3:
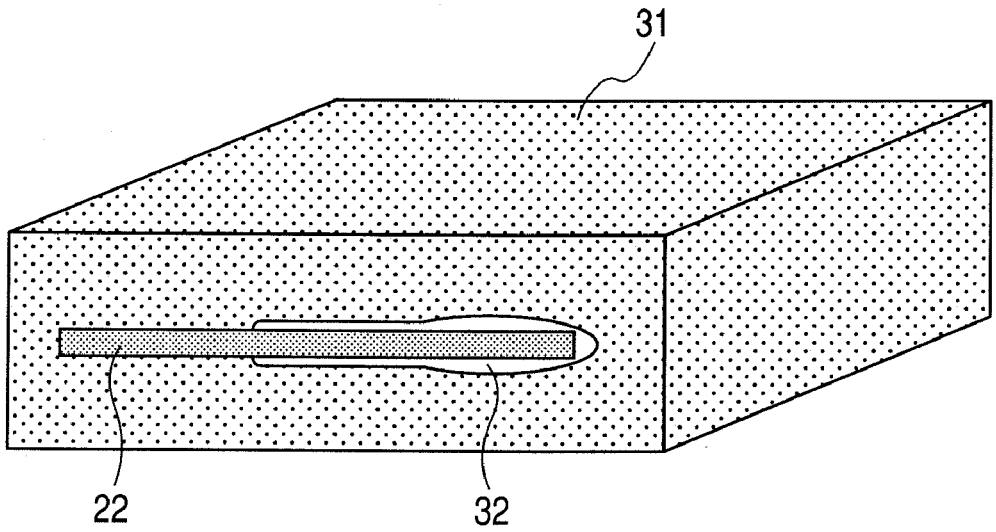
FIG. 3 is a schematic view showing the construction of an example of an extruder die used in the apparatus for manufacturing the developer level control blade of the present invention.

First, while the blade member material was melted at 200 to 270° C. in an extruder (manufactured by PLAGIKEN Co., Ltd.), it was extruded therefrom and inserted into a special die 31 shown in FIG. 3, having an extrusion orifice having a blade member material extrusion orifice 32 which was substantially elliptic in shape, of 10 mm×maximum 0.5 mm. At the same time, while the continuous metal member for the support member, having been wound up on the coil stand 110, was wound off therefrom and made to run through a mold cavity of this special die 31, the blade member material melted to liquefy was successively injected into that mold cavity, where the blade member material having liquefied and the metal member for support member were joined to concurrently make the former cover the latter partly at least at its part extending from the contact support face to the edge face. Here, the temperature of the special die 31 was set at 250° C.

The blade member material thus joined with the continuous thin-sheet metal member 101 was extruded from the special die 31 (extruder die 112) after the shape of its extrusion orifice 32, and then moved to the cooling unit 114 to solidify the blade member material polyamide elastomer covering the metal member, thus a sheet for the developer level control blade the cover layer of which was formed at least at its part extending from the contact support face to the edge face of its support member as shown in FIG. 2 was obtained as a continuous blade.

The thickness of the blade member cover layer to be formed on the support member was adjusted by changing the extrusion rate of the resin and the feed rate of the phosphor bronze sheet. The developer level control blade sheet thus obtained was transported with the roll unit 115 and then press-cut with the cutter 116 into a blade size of 200 mm in length to obtain the developer level control blade.

The ten-point average roughness (Rz) of the blade member surface of this developer level control blade was measured with a contact type surface roughness meter as prescribed in JIS B 0601 to find that it was 0.3 μm.

The developer level control blade formed by this manufacturing process can secure a certain toner intake between the blade and the developer carrying member to make uniform the pressure of contact of the blade with the developer carrying member. Thus, the developer level control blade that can form the developer layer on the developer carrying member in a proper thickness and in a uniform state can be formed continuously and at a low cost.

Comparative Example 1

A polyamide elastomer (available from Daicel-Degussa Ltd.; trade name: DAIAMID E40,) was injection-molded at 250° C. to prepare a blade member of 200 mm in length in the lengthwise direction, 5 mm in width and 1 mm in thickness. As a mold used here, its inner surface stood mirror-finished, where the ten-point average roughness (Rz) of the blade member surface was measured with the contact type surface roughness meter as prescribed in JIS B 0601 to find that it was 0.3 μm. The mold temperature was set at 40° C.

Figure 5:
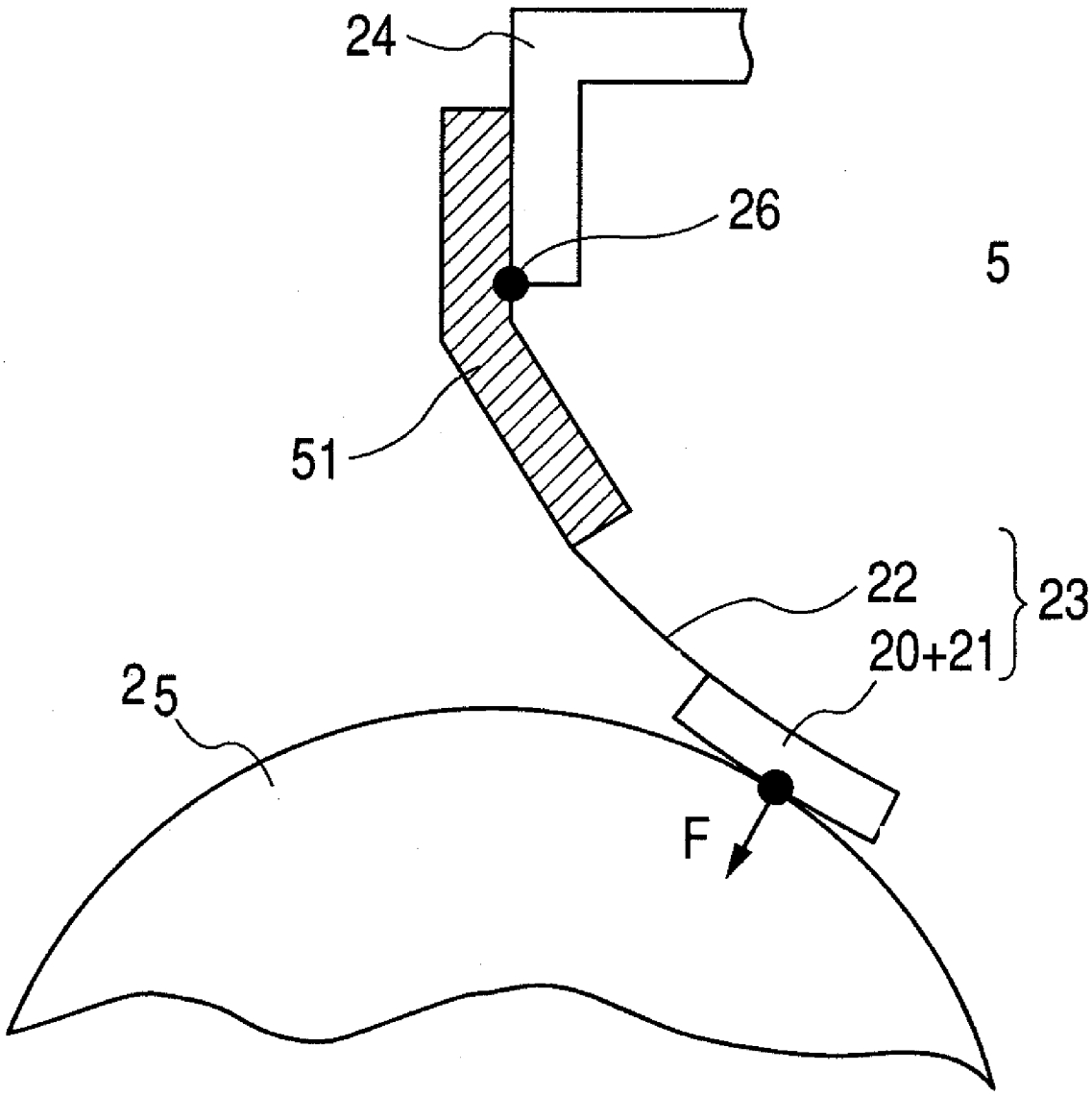
FIG. 5 is a schematic view showing the construction of an example of a conventional developer level control blade.

The blade member obtained was bonded to an end portion of a phosphor bronze sheet of 200 mm in length in the lengthwise direction, 23 mm in width and 0.1 mm in thickness to produce a developer level control blade structured as shown in FIG. 5.

The developer level control blade formed by this manufacturing process is obtained through separate steps for the molding of the blade member and the bonding of the blade member to the support member, and can not enjoy any continuous molding. Accordingly, defects tend to come about during working, and also a high manufacturing cost may result.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-098359, filed Apr. 4, 2007, which is hereby incorporated by reference herein in its entirety.

What is claimed is:

1. A process for manufacturing a developer level control blade having at least a support member and a blade member, which controls the level of a developer carried by a developer carrying member out of a developer container, the process comprising the steps of:

placing in an extruder die for giving a blade edge shape a continuous thin-sheet metal member for forming the support member, at a position where the metal member is to be provided with a liquid blade member material for forming the blade member;

extruding the blade member material, having been melted to liquefy, into the extruder die;

covering the metal member at an edge portion thereof with the liquid blade member material to join the both together, thereby covering the metal member with the liquid blade member material at least in a region extending from a contact support face of the metal member to an edge face of the metal member, the region corresponding to a portion of the support member where the blade member is to come into contact with the developer carrying member;

cooling the liquid blade member material on the metal member to solidify to form a continuous blade; and cutting the continuous blade in a preset length.

2. The process for manufacturing a developer level control blade according to claim 1, wherein, in the material covering step, the shape of the blade is adjusted by adjusting an extrusion orifice of the extruder die, from which the liquid blade member material is ejected together with the metal member in an integral form.

3. The process for manufacturing a developer level control blade according to claim 1, wherein the blade member material is a material comprising a resin or an elastomer.

4. The process for manufacturing a developer level control blade according to claim 1, wherein the blade member material is a material comprising at least one selected from the group consisting of a polyamide, a polyamide elastomer, a polyester, a polyester elastomer, polyester terephthalate, a polyurethane, a silicone rubber, a silicone resin and a melamine resin.

5. The process for manufacturing a developer level control blade according to claim 1, wherein, in the material covering step, the metal member is covered with the liquid blade member material also on a back surface of the metal member, the back surface being opposed to the contact support face.

6. The process for manufacturing a developer level control blade according to claim 1, wherein the metal member is covered with the liquid blade member material via an adhesive.

7. A developer level control blade formed by the manufacturing process according to claim 1, wherein the blade includes the metal member forming the support member and the blade member material forming the blade member, and the blade member material covers at least a portion of each of the contact support face and the edge face of the metal member.

8. The developer level control blade according to claim 7, wherein the blade member covering the support member has a thickness of from 5 μm or more to 600 μm or less at its part on an edge face of the support member.

9. The developer level control blade according to claim 7, wherein the blade member covering the support member has a thickness of from 10 μm or more to 500 μm or less at its part on a contact support face of the support member.

10. The developer level control blade according to claim 7, wherein the blade member covering the support member has a rounded shape free of acute-angled areas at least in a region extending from a contact support face, which comes into contact with the developer carrying member, to an edge face of the blade member.

11. The developer level control blade according to claim 7, wherein the blade member covering the support member has a surface roughness of from 0.1 μm or more to 3.0 μm or less as ten-point average roughness (Rz) at least at its face of contact with the developer carrying member.

12. The developer level control blade according to claim 7, wherein the blade member covering the support member is formed also on a back surface of the support member, the back surface being opposed to the contact support face.

13. The developer level control blade according to claim 7, wherein the blade member is formed on the support member via an adhesive layer.

* * * * *